US008075026B2

(12) United States Patent
Pritzke et al.

(10) Patent No.: US 8,075,026 B2
(45) Date of Patent: Dec. 13, 2011

(54) LOCKING SYSTEM FOR A CLOSING FLAP

(75) Inventors: Heinz Pritzke, Kasselsdorf (DE); Reginald Koehler, Dresden (DE); Detlef Boerner, Dresden (DE)

(73) Assignee: Glatt Systemtechnik GmbH, Dresden (DE)

( * ) Notice: Subject to any disclaimer, the term of this patent is extended or adjusted under 35 U.S.C. 154(b) by 1055 days.

(21) Appl. No.: 11/907,705

(22) Filed: Oct. 16, 2007

(65) Prior Publication Data

US 2008/0098776 A1 May 1, 2008

(30) Foreign Application Priority Data

Oct. 19, 2006 (DE) ..... 10 2006 049 286

(51) Int. Cl.
*E05C 5/00* (2006.01)
*E05B 15/02* (2006.01)

(52) U.S. Cl. ..... 292/63; 292/341.15; 292/341.6

(58) Field of Classification Search ..... 292/63, 292/64, 66, 67, 341.15, 341.16
See application file for complete search history.

(56) References Cited

U.S. PATENT DOCUMENTS

| | | | | |
|---|---|---|---|---|
| 2,786,701 | A * | 3/1957 | Povlich | 292/144 |
| 3,765,709 | A * | 10/1973 | Van Wyck | 292/33 |
| 5,746,456 | A * | 5/1998 | Violi et al. | 292/146 |
| 6,092,846 | A * | 7/2000 | Fuss et al. | 292/302 |
| 2008/0127684 | A1 * | 6/2008 | Rudduck et al. | 70/77 |

FOREIGN PATENT DOCUMENTS

DE 102004036273 A1 * 3/2006

* cited by examiner

*Primary Examiner* — Carlos Lugo
(74) *Attorney, Agent, or Firm* — Jacobson Holman PLLC

(57) ABSTRACT

An automatically or manually operable closure system for a closing flap on a transport container is situated on the container frame and a docking stand at an unloading station. A rotating device for moving the closing flap is provided on the docking stand and a locking device for locking the closing flap in the closed position is provided on the container frame. A flap shaft, whose other end is mounted rotatably in the container frame and is implemented as a first connection element, engages axially to the rotational axis of the closing flap. The first connection element is axially coupled using a torsion-fixed tongue-groove pair to an axially displaceable second connection element. Formfitting coupling elements are provided on the second connection element and on the driveshaft for moving the closing flap.

4 Claims, 4 Drawing Sheets

LOCKING SYSTEM FOR A CLOSING FLAP

FIELD OF THE INVENTION

The invention relates to a locking system for a closing flap, in particular for the automatic opening and closing of closing flaps at transportation containers in connection with an unloading station or an arrangement, in which the content of the transportation container shall be unloaded.

BACKGROUND OF THE INVENTION

According to prior art various locking systems are known for closing flaps. In a robust operation for unloading transportation containers the closing flaps are frequently opened and closed manually at the unloading site.

Arrangements are also known, which are provided directly at the transportation container and can be opened and closed in different ways. For example, DE 10 2004 036 273 A1 describes a locking and removal arrangement for a silo or bulk goods container with a silo flap sluice to close the output opening. Here, the motor to operate the silo flap sluice is coupled directly to its shaft. Here, the silo flap sluice comprises several semi-circular segments allowing a dosed extraction.

In locking devices directly connected to the transportation container it is disadvantageous that each transportation container must be provided with a respectively expensive device. In particular in manually operated locking devices additional arrangements for fixing the closing flaps are necessary to prevent an unintended automatic opening. Such arrangements for fixing shall prevent that unloading already occurs before the transportation container has reached the necessary position above the unloading station or that the closing flap opens automatically, e.g., in a container mixer. The known devices for fixing closing flaps prevent the use of automated locking systems.

SUMMARY OF THE INVENTION

The object of the invention is to provide a locking system for a closing flap requiring little technical expense, being suitable for a safe automatic operation, and allowing manual operation of the locking system and the fixing arrangement, when necessary.

This object is attained according to the invention by the features disclosed. Advantageous embodiments of the invention are described in greater detail in the following together with the description of the preferred embodiment of the invention, including the drawings.

According to the invention the individual elements of the locking system are arranged separately by a container frame at the transportation container and by a docking frame at the unloading station. The mechanical elements necessary for unlocking and locking the closing flap are provided at the transportation container and the rotary device to be operated using energy at the unloading station, generally arranged stationary. The locking system as a whole can only be operated in the duly combined position of the transportation container in reference to the docking frame. Due to the fact that usually a large number of transportation containers are used in combination with only one or a few unloading stations(s) the number and the expense for the rotary device can be considerably reduced.

The locking system can only be operated when the container frame is placed correctly on the docking frame at the unloading station. The locking system is provided, in addition to the closing flap, with a rotary device for moving the closing flap and a locking device for locking the closing flap in the closed position.

Axially in reference to the rotary axis of the closing flap a flap shaft engages the closing flap, its opposite end being supported rotary in a container frame and embodied as a first connecting element.

Form-fitting in reference to the first connection element, at the flap shaft a second connection element is supported in the container frame in a rotary and axially displaceable manner. The first connection element and the second connection element are coupled to each other in a torque-proof, axially displaceable manner, via a tongue-and-groove match. Between the two connection elements an axially acting spring is arranged such that the two connection elements are pressed apart. As a spring, advantageously a pressure spring is used, however other constructions with other types of springs are also possible.

In the closing position of the closing flap the second connection element engages a torque-proof locking element. In order to open the closing flap this second connection element can be displaced in the axial direction with it disengaging the locking element.

The rotary device is provided at the docking frame and fastened to the displaceable carrier such that in the idle position of the transportation container, with the container frame being supported on the docking site, a drive shaft of the rotary device and the flap shaft are aligned in one axis. For the automatic movement of the closing flap, at the second connection element and at the drive shaft of the rotary device, form-fitting in reference to each other, matching coupling elements are provided, which can be coupled to each other and decoupled by a displacement of the carrier of the rotary device, with the second connection element being axially displaced in the coupled position and being decoupled from the locking element. Here the second connection element and the corresponding coupling element are embodied at the axially opposite ends of a constructive element.

In order to manually operate the closing flap a manual lever is provided at the flap shaft. It can only be operated, though, if the fixing device is unlocked. Due to the fact that the axially acting spring between the first and the second connection element keeps the locking device blocked at all times, it is necessary that the operator, for a manual opening of the closing flap, manually presses the second connection element against the spring and thus decouples the locking element.

The locking system according to the invention ensures a safe automatic or manual operation of the closing flap, with the closing flap being constantly fixed and only operable by a special automatic or manual loosening of the fixing device. The secure fixing of the closing flap is necessary, e.g., when a relatively large transportation container, with its closing flap showing a diameter of 250 mm, is inserted into a container mixer and is rotated therein around several axes.

BRIEF DESCRIPTION OF THE DRAWINGS

The invention is explained in greater detail in the following, using an exemplary embodiment. Allocated to the exemplary embodiment.

DETAILED DESCRIPTION OF THE PREFERRED EMBODIMENTS

The locking system according to the invention comprises a multitude of elements specifically allocated to the independent structures of transportation container 1 with a container frame 2 as well as a docking frame 3 at an unloading station, which may be provided at a processing arrangement, a mixing station, a container, or the like.

Figure 1A:
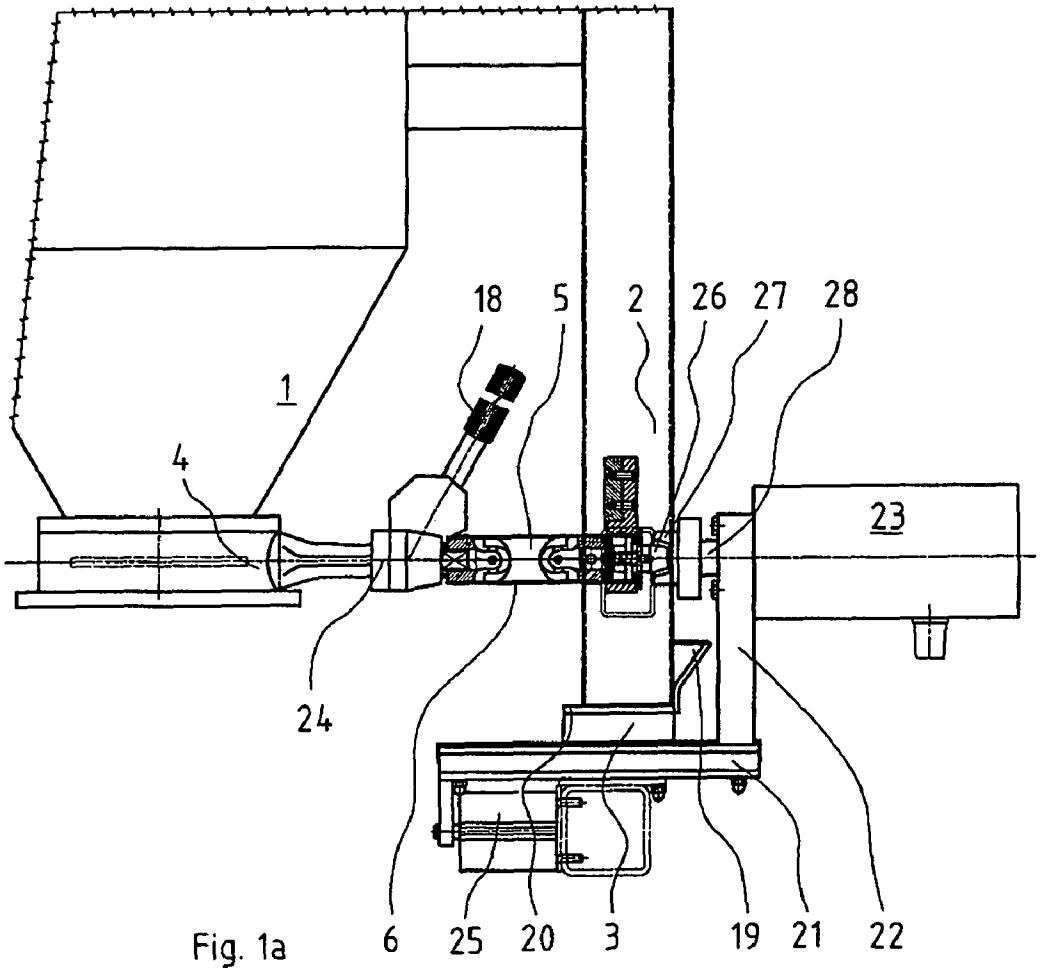
FIG. 1*a* shows a cross-section through a container frame, placed upon a docking frame, in the area of a locking device.

FIG. 1*a* shows a transportation container 1 with a container frame 2 placed in the idle position onto a docking frame 3. At the closing flap 4, having a rotary axis 24 at the lower end of the transportation container 1, a flap shaft 5 engages, which is for example embodied as a power train to compensate production tolerances and covered with a plastic tube 6 according to prior art to protect it from contamination. The flap shaft 5 is supported in a rotary manner in the container frame 2.

Figure 1B:
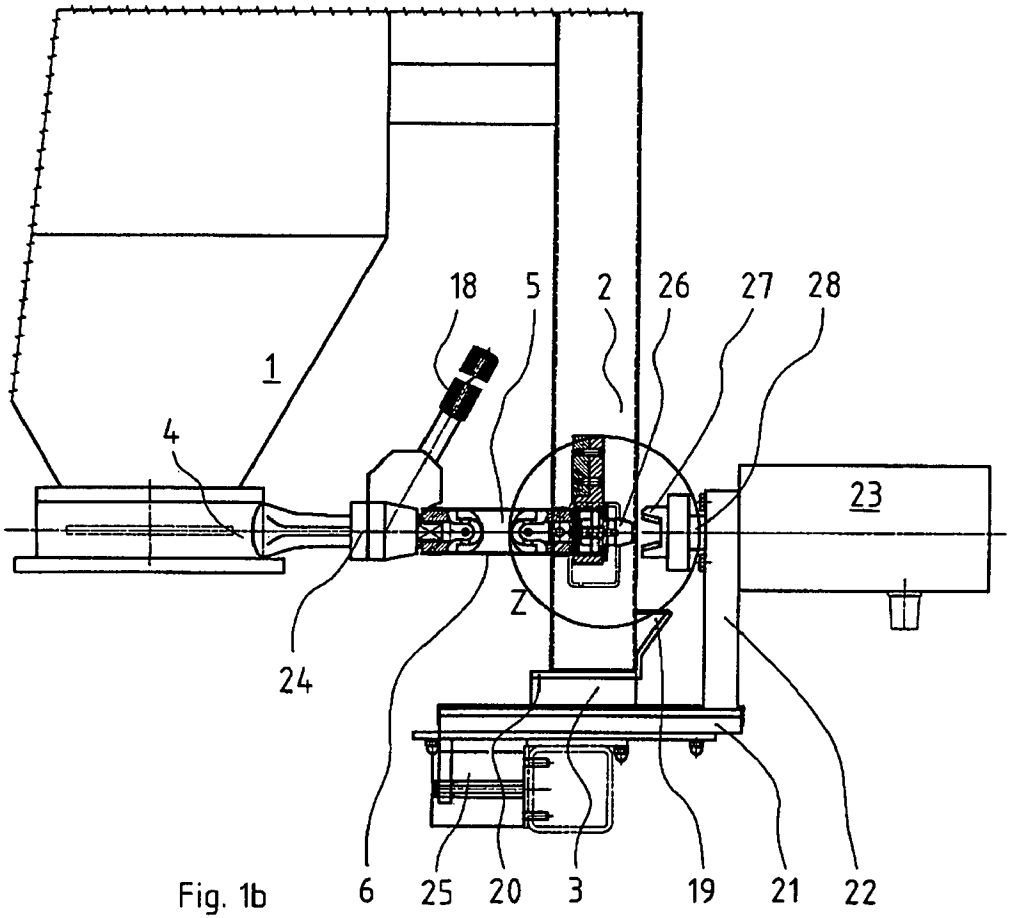
FIG. 1*b* shows a cross-section through the container frame, with the carrier displaced to the right.

FIG. 1*b* shows the pneumatic drive 25 with carrier 21 displaced toward the right, where transportation container 1 with container frame 2 can be removed from docking frame 3. The closing flap 4 is closed.

Figure 2A:
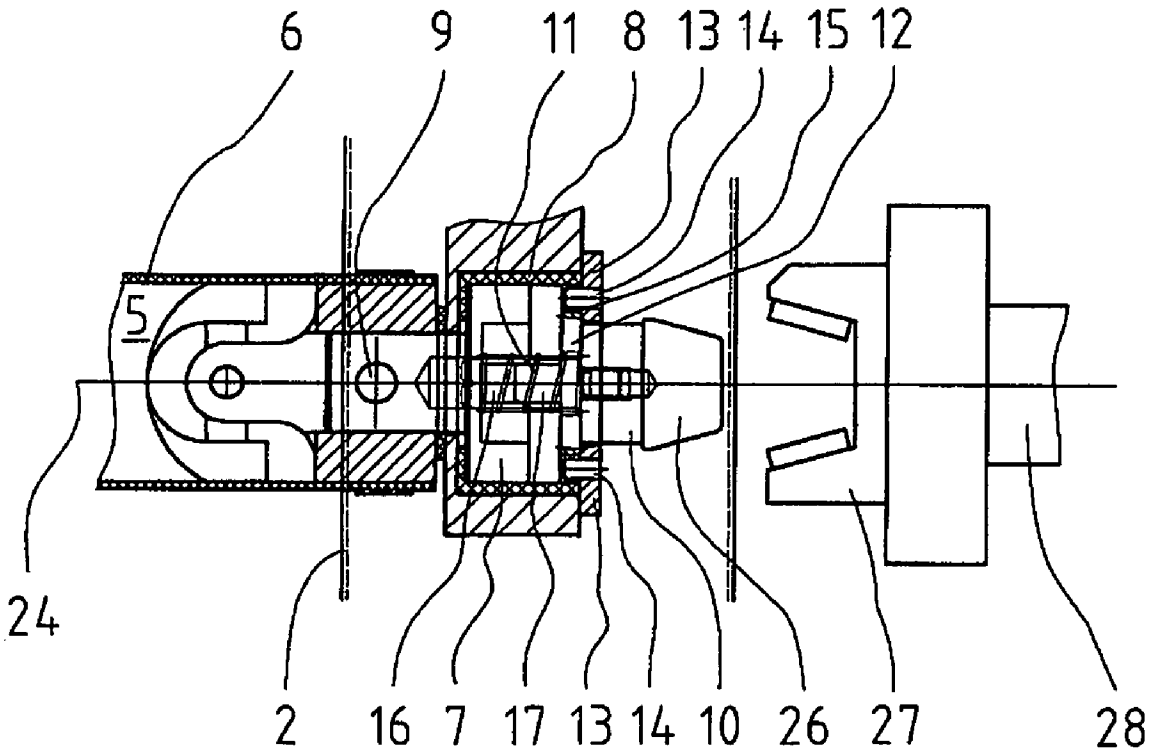
FIG. 2*a* shows a section Z of FIG. 1*b*.

In FIG. 2*a*, the support of the flap shaft 5 in the container frame 2 is illustrated in greater detail. At the end of the flap shaft 5 a first connection element 7 is provided, which is supported in a rotary fashion in a bearing bushing 8 and which is connected to the flap shaft 5 in a torque-proof manner by a bolt 9. Opposite to the first connection element 7 a second connection element 10 is provided. Here, the first connection element 7 is provided with a groove 16 and the second connection element 10 with a matching spring 17, which can engage each other and are coupled torque-proof in an axially displaceable manner. Between the two connection elements 7 and 10 an axially acting pressure spring 11 is arranged such that the connection elements 7 and 10 are pressed apart in the rotary axis 24 of the flap shaft 5.

The second connection element 10 is supported in a rotary fashion inside the bearing bushing 8 and held axially with a lid 13 comprising two parts. Within the bearing bushing 8 the second connection element 10 has a plate 12 with radial recesses 15. A part of the second connection element 10 penetrates the lid 13 and has an external section embodied as a coupling element 26.

In order to realize the locking element according to the invention the lid 13 is provided with two fixation bolts 14 protruding into the bearing bushing 8, which are arranged in the plate 12 matching the recesses 15, with in the idling condition of the locking system the plate 12 is pressed against the lid 13 by the pressure spring 11 such that the fixing bolt 14 engages the recesses 15 and the entire locking system is fixed.

The embodiment of the docking frame 3 depends on the totality of defined conditions. Positioning aids 19 with support surfaces 20 are essential, engaged by feet at the container frame 2, with the position of the transportation container 1 being precisely predetermined in the docking frame 3.

At the docking frame 3 a carrier 21 is arranged displaceable in the horizontal direction, which is operated by a pneumatic drive 25 in the exemplary embodiment. A pneumatically operated rotary drive 23 with a drive shaft 28 in the rotary axis 24 is supported at a vertical flange 22, fixed to the carrier 21. The rotary axes of the rotary drive 23 and the closing flap 4 are thus located in the same axis.

At the end of the drive shaft 28, located opposite the coupling element 26 at the second connection element 10, an almost form-fittingly matching coupling element 27 is arranged. This way the drive shaft 28 is connected to the coupling element 26 via the combined construction element and (via) the connection element 10 to the connection element 7, the flap shaft 5, and the closing flap 4.

Figure 2B:
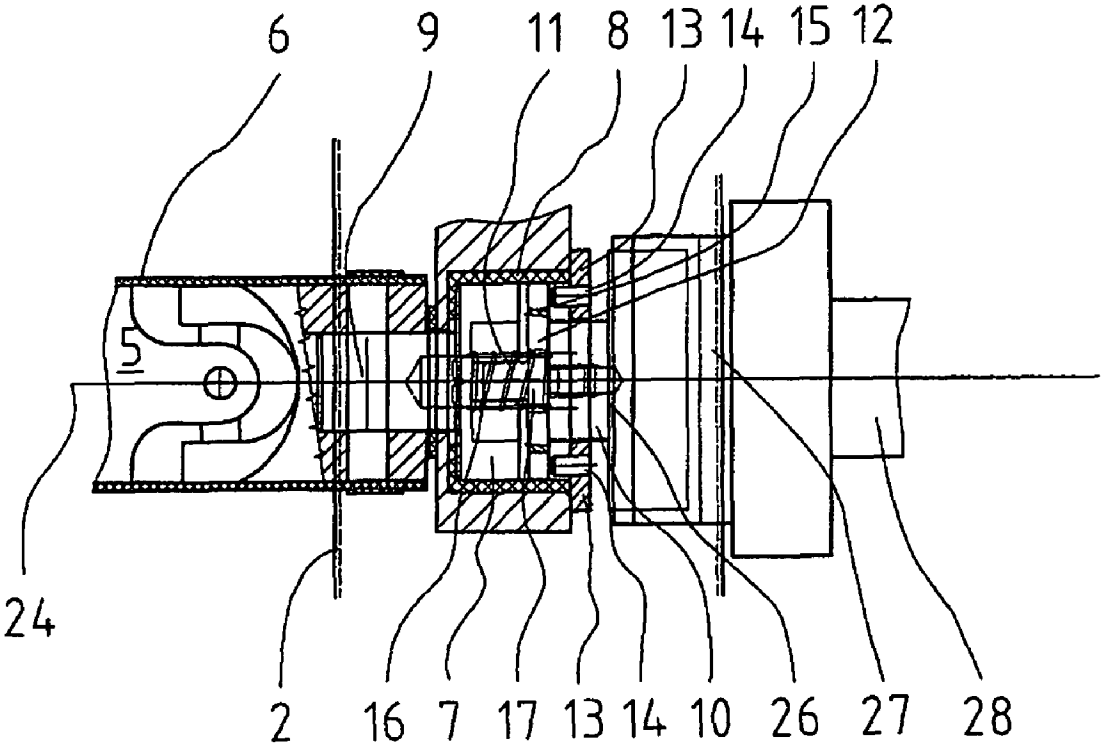
FIG. 2*b* shows the coupling element shifted.

FIG. 2*b* shows the position in which coupling element 27 works on coupling element 26, and plate 12 is shifted to the left against the resistance of compression spring 11. Fixation bolts 14 are located outside the recesses 15, and flap shaft 5 is turned 90 degrees. As a result, the closing flap 4 is in the open position, but is not yet latched. Closing flap 4 is not latched until coupling element 27 is removed toward the right from coupling element 26 and compression spring 11 displaces plate 12 to the right. In so doing, the fixation bolts 14 engage the recesses 15 moved 90 degrees (with respect to FIG. 2*a*).

Additionally, a manual lever 18 is arranged in a torque-proof manner at the flap shaft 5 (FIG. 1*a*).

In the following, the locking system is explained in greater detail in its application. In the separated position, when the transportation container 1 is not placed onto the docking frame 3, the second connection element 10 is held with the plate 12 at the lid 13 by the pressure spring 11 such that the fixing bolts 14 engage the recesses 15 in the plate 12. In this position, the connection element 10 cannot be rotated. By the torque-proof engagement of the spring 17 with the groove 16 as well as the torque-proof connection of the first connection element 7 to the flap shaft 5 and the closing flap 4 the closing flap 4 is also fixed and cannot be opened by the manual lever 18. Only when necessary, the coupling element 26 at the second connection element 10 can be manually pressed against the force of the pressure spring 11 in the bearing bushing 8 such that the recesses 15 disengage the fixing bolts 14. Then, the closing flap 4 can be opened with the manual lever 18.

When the transportation container 1 is placed onto the docking frame 3 the closing flap 4 can be opened automatically with the locking system according to the invention. For this purpose sensors can control the correct position and also directly the opening of the closing flap 4 can directly be initiated automatically by signals of the sensors. The manual access to the coupling element 26 is impossible in this position.

In order to open the closing flap 4 the carrier 21 with the rotary drive 23 and the coupling element 27 is displaced in the direction of the coupling elements 26 at the second connection element 10 and the second connection element 10 defined by known off-switches is pressed into the bearing bushing 8, until the recesses 15 disengage the fixation bolt 14. Then the rotary drive 23 with the coupling element 27 can be rotated by 90° thus, as already described, opening the closing flap 4.

The invention claimed is:

1. A closure system for a closing flap on a transport container having a container frame that is placed onto a docking frame in a fitting manner at an unloading station, with a rotary device for moving the closing flap, said closure system comprising a flap shaft acting axially at one end with respect to an axis of rotation of the closing flap, the other end of the flap shaft being mounted rotatably in the container frame and being a first connecting element, the first connecting element being axially coupled by a rotationally fixed pairing of a tongue in a groove to a second connecting element, the second connecting element being mounted in the container frame, and being axially displaceable, an axially acting compression spring being arranged between the first connecting element and the second connecting element such that the first connecting element and the second connecting element are pressed apart, in the closed position of the closing flap, the second connecting element engaging a rotationally fixed element and, for opening of the closing flap, the second connecting element being displaced in an axial direction, with the second connecting element being disengaged from the rotationally fixed element, the rotary device being provided on the docking frame and being secured on a displaceable support such that, in an inoperative position of the transport container, with the container frame on the docking frame, a drive shaft of the rotary device and the flap shaft lie on a common axis, and to move the closing flap, coupling elements fit together in an interlocking manner and are present on the second connecting element and on the drive shaft, the coupling elements being coupled to or decoupled from each other by displacement of the support of the rotary device, the second connecting element being axially displaced in the coupled position and being decoupled from the first connecting element.

2. The closure system for a closing flap according to claim 1, wherein the first connecting element and the second connecting element are supported jointly in a bearing bushing.

3. The closure system for a closing flap according to claim 1, wherein the flap shaft is a shaft with universal joints.

4. The closure system for a closing flap according to claim 1, wherein the rotary device is rotated and displaced on the support.

* * * * *